US009889914B1

(12) United States Patent
Ostrowsky

(10) Patent No.: US 9,889,914 B1
(45) Date of Patent: Feb. 13, 2018

(54) TROLLING MOTOR MOUNT

(71) Applicant: Kenneth Alan Ostrowsky, Scranton, PA (US)

(72) Inventor: Kenneth Alan Ostrowsky, Scranton, PA (US)

( * ) Notice: Subject to any disclaimer, the term of this patent is extended or adjusted under 35 U.S.C. 154(b) by 0 days.

(21) Appl. No.: 15/369,689

(22) Filed: Dec. 5, 2016

(51) Int. Cl.
*B63H 20/16* (2006.01)
*B63H 20/00* (2006.01)
*B63H 20/06* (2006.01)

(52) U.S. Cl.
CPC ..... *B63H 20/16* (2013.01); *B63H 20/007* (2013.01); *B63H 20/06* (2013.01)

(58) Field of Classification Search
CPC ..... B63H 20/007; B63H 20/05; B63H 20/16
USPC ..... 440/60
See application file for complete search history.

(56) References Cited

U.S. PATENT DOCUMENTS 1,365,182 A * 1/1921 Melchior ..... B67B 3/10 100/257
3,948,204 A * 4/1976 Brock ..... B63H 20/007 248/642
4,708,670 A * 11/1987 Peters ..... B63H 20/007 248/642
4,911,398 A * 3/1990 Dilulio ..... B63H 20/007 248/642
5,173,686 A * 12/1992 Fujihara ..... G09F 9/35 248/920
5,262,762 A * 11/1993 Westover ..... B41J 5/10 341/22
5,669,794 A * 9/1997 Knight ..... B63H 20/007 248/642
5,847,685 A * 12/1998 Otsuki ..... B60K 35/00 248/920
7,972,188 B2 * 7/2011 Bernloehr ..... B63H 20/08 248/640
9,296,455 B2 * 3/2016 Bernloehr ..... B63H 5/125

OTHER PUBLICATIONS

KV 8090 Series 4×4 Pocket Door Slide, Knape & Vogt Manufacturing Company, 2002.

* cited by examiner

*Primary Examiner* — Lars A Olson
*Assistant Examiner* — Jovon Hayes
(74) *Attorney, Agent, or Firm* — IP Legal Services, LLC

(57) ABSTRACT

In described embodiments, a motor mount includes a track with guide rails defining a channel, a sled within the channel, first and second end blocks between the guide rails at first and second ends, and a rotatable rod between the end blocks. The first end block has a rack formed thereon, and the guide rails form an opening adjacent to the first end block. Top and bottom plates of the sled have corresponding ends fixed with a hinge, the top plate fastened about the rod, the bottom plate have a gear formed around the hinge, and the hinge facing toward the first end block. Rotating the rod moves the hinge toward the first block and when the gear of the bottom plate engages the rack, the bottom plate rotates about the hinge through the opening and extends inverted over the first end block to an extended position.

11 Claims, 5 Drawing Sheets

51

TROLLING MOTOR MOUNT

BACKGROUND OF THE INVENTION

Field of the Invention

The present invention relates to motor mounts, and, in particular, to a motor mount for storing a trolling motor assembly below a surface of, for example, a deck.

Description of the Related Art

The pleasure boat industry has exploded in recent years, and to meet the needs of fishing boats, for example, trolling motors have become popular. A trolling motor is usually a secondary source of propulsion for a vessel. Trolling motors allow for a relatively small amount of thrust to propel a boat or other vessel through the water slowly and quietly. Typically, trolling motors are electric powered, using the vessel's existing power source or stand-alone power source (e.g., a separate battery). Such trolling motors are typically mounted to the top surface of the vessel's deck, and are configured to allow for storage of the trolling motor on top of the surface when not in use. Early designs allowed for manual manipulation of the trolling motor assembly to place it in the stowed position. For example, the trolling motor assembly might comprise a motor base and a propulsion shaft, where the propulsion shaft includes a propeller, and an optional head unit. In operation, the propulsion shaft is perpendicular to the motor base and extended downward into the water. Stowing the trolling motor includes lifting the propulsion shaft upward out of the water, and rotating the shaft to a horizontal and parallel position to the deck.

Recently, trolling motors have been designed that allow for such manipulation of the trolling motor assembly to transition between a deployed/extended position in operation to the stowed position, and vice-versa, automatically or with mechanical assistance. For example, U.S. Pat. No. 9,296,455 entitled "Trolling Motor" to Bernloehr et al., filed Apr. 17, 2014, describes such a trolling motor that provides mechanically assisted or automated stow/deploy and trim adjustment mechanisms. The trolling motor includes a motor base assembly with a steering module mounted to the base assembly. The steering module includes an internal drive arrangement for providing an output torque. The steering module also includes a trim module rotatably mounted to an upper portion of the steering module. A motor shaft assembly including a motor shaft, a head unit attached to an upper end of the motor shaft, and a motor power unit attached to a lower end of the motor shaft is also provided. The motor shaft extends through the base assembly, steering module, and trim module. A torque transfer arrangement is mounted between the trim module and the motor shaft of the motor shaft assembly for transferring the output torque provided by the steering module to the motor shaft to rotate the motor shaft assembly about a rotational steering axis. Such a trolling motor advantageously provides a user with a contemporary trolling motor at a lower cost of purchase, operation, and maintenance given a more compact and efficient design.

The recreational boat industry includes other types of pleasure craft, such as "lake boats" for similar applications. One type of such pleasure craft is a pontoon boat, which is a low-deck height (or "flattish") boat that relies on pontoons to float. Common pontoon boat designs include lake boats, fishing boats, catamarans, and the like with a deck positioned over two (or more) pontoons. Pontoons may be simply constructed from sealed cylinders such as pipes or barrels, or fabricated as boxes from metal or concrete. Pontoon boat drafts may be as shallow as eight inches, which reduces risk of running aground and underwater damage, and are ideal for lake use. Pontoon boats for pleasure boating and fishing can be low cost for their capacity, and sales of such watercraft have exploded in recent years.

Trolling motors might be employed with pontoon boats, but their use is generally awkward. In a small fishing vessel, the trolling motor is typically fixed to the top deck at the bow, but in pontoon boat deck space and access to the foredeck (bow) is limited. Consequently, trolling motors are seldom used with, or installed in, pontoon boats.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a motor mount to deploy a boat motor comprising a track with guide rails extending along each side of the track to form a channel, and a sled positioned within the channel. The track includes a first end block between the guide rails at a first end, a second end block between the guide rails at a second end, and a rod rotatably fixed between the first and second end blocks, wherein the first end block has a rack formed thereon opposite to a top surface of the track, and the guide rails form an opening adjacent to the first end block, between the first and second end blocks, and opposite to the track top surface. The sled includes a top plate and a bottom plate, the top plate and the bottom plate having corresponding ends fixed with a hinge, the top plate fastened about the rod, the bottom plate have a gear formed around the hinge, and the hinge positioned facing toward the first end block. Rotating the rod in a first direction through the top plate moves the hinge of the sled within the channel toward the first end block, and rotating the rod in a second direction moves the sled within the channel toward the second end block and, when the rod rotates in the first direction and reaches the first block, the gear of the bottom plate engages the rack of the first end block, the bottom plate rotates about the hinge through the opening, and extends inverted over the first end block to an extended position.

BRIEF DESCRIPTION OF THE DRAWINGS

Other aspects, features, and advantages of the present invention will become more fully apparent from the following detailed description, the appended claims, and the accompanying drawings in which like reference numerals identify similar or identical elements.

DETAILED DESCRIPTION

In accordance with described embodiments, a motor mount for use with, for example, a trolling motor, allows for automatic or otherwise mechanical deployment of the trolling motor when in operation and stowing of the trolling motor under a deck when not in use. Such motor mount as described herein might advantageously be used with, or installed in, pontoon boats. When employed for such pontoon boat applications, the trolling motor might be stored under the pontoon boat deck and between the pontoons. Embodiments of the motor mount described herein might be powered using the existing power source or stand-alone power source (e.g., a separate battery) of the pontoon boat. Preferred embodiments of the motor mount might be advantageously employed in conjunction with the type of trolling motor described in, for example, U.S. Pat. No. 9,296,455 entitled "Trolling Motor" to Bernloehr et al., filed Apr. 17, 2014, the teachings of which are incorporated in their entirety herein by reference.

Figure 1A:
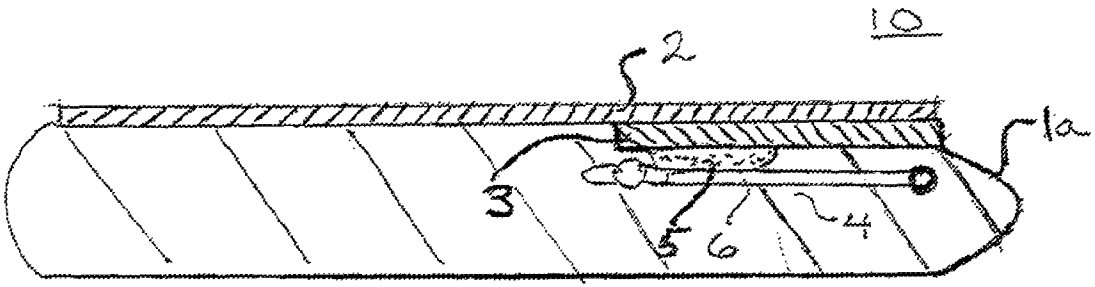
FIG. 1A shows a side view of a pontoon boat employing an exemplary embodiment of the present invention in a stowed position.
Figure 1B:
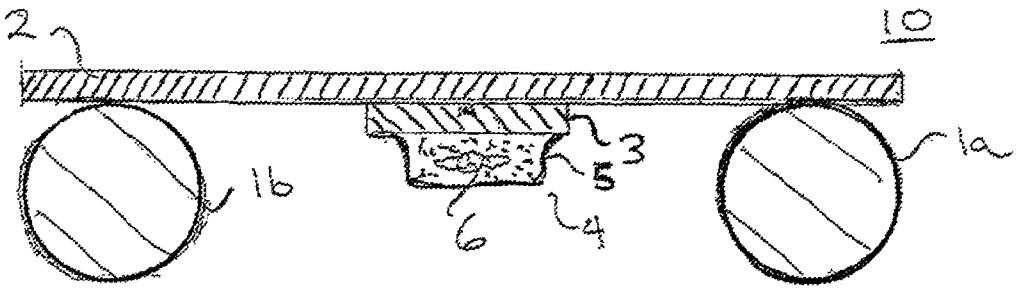
FIG. 1B shows a front (bow) view of a pontoon boat employing the exemplary embodiment of the present invention in a stowed position.
Figure 1C:
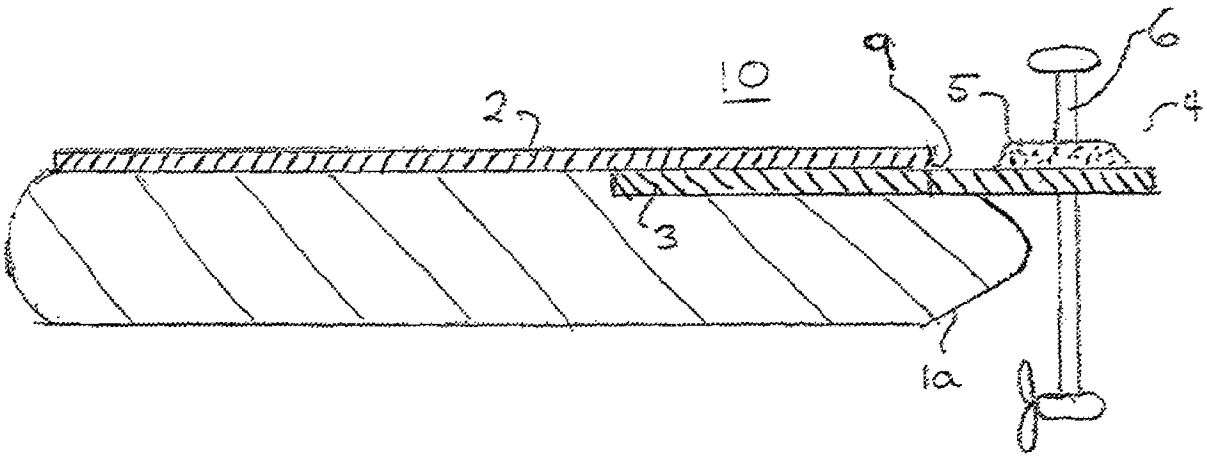
FIG. 1C shows a side view of a pontoon boat employing an exemplary embodiment of the present invention in a deployed position.

Before describing an exemplary embodiment of the trolling motor mount, use of the trolling motor mount, its general configuration and advantages is described with respect to FIGS. 1A, 1B and 1C. FIG. 1A shows a side view of pontoon boat 10 employing an exemplary embodiment of the present invention in a stowed position. FIG. 1B shows a front (bow) view of pontoon boat 10 employing the exemplary embodiment of the present invention in a stowed position. In accordance with exemplary embodiment, pontoon boat 10 having a deck 2 includes the exemplary embodiment of trolling motor mount 3 fastened under deck 2. Trolling motor assembly 4 includes a motor base 5 and propulsion shaft 6. In a stowed position, trolling motor 10 includes propulsion shaft 6 rotated to a horizontal (also with respect to motor base 5) and parallel position to deck 2. Trolling motor assembly 4 in a stowed configuration is mounted to a bottom surface of trolling motor mount 3, under deck 2, and between pontoons 1*a* and 1*b*, allowing for storing the motor when not in use in a protected position underneath deck 2.

FIG. 1C shows a side view of a pontoon boat employing an exemplary embodiment of the present invention in a deployed position. Motor mount 3 is now extended beyond front 9 of pontoon boat 10, inverting motor base 5. In operation, propulsion shaft 6 is perpendicular to motor base 5 and extended downward into the water. Such trolling motor mount advantageously provides a user with a contemporary trolling motor given a more compact and efficient design that can be employed easily in pontoon boats.

Figure 2:
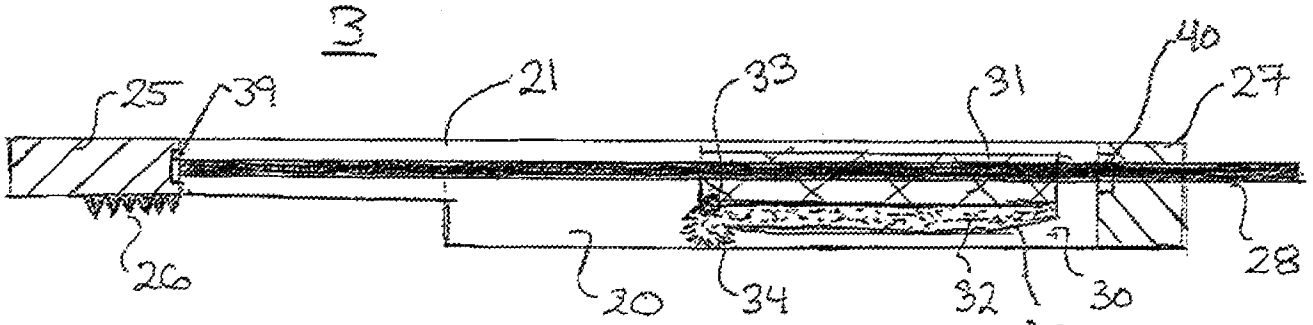
FIG. 2 shows diagram of an exemplary embodiment of the trolling motor mount from the side.

An exemplary embodiment of a trolling motor mount in accordance with the present invention is now described. FIG. 2 shows diagram of an exemplary embodiment of the trolling motor mount viewed from the side in a stowed position, and FIG. 3 shows diagram of an exemplary embodiment of the trolling motor mount viewed from the bottom in the stowed position.

Figure 3:
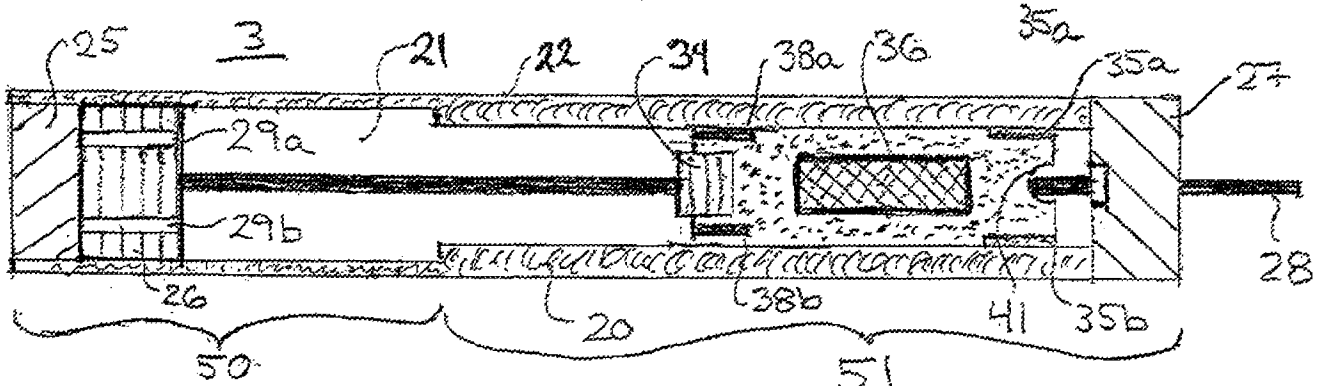
FIG. 3 shows diagram of an exemplary embodiment of the trolling motor mount from the bottom.

Referring to FIGS. 2 and 3, trolling motor mount 3 includes track 20, sled 30, threaded rod 28 (e.g., a worm or screw), first end block 25, and second end block 27. First end block 25 is positioned at one end of the channel of track 20 generally near, for example, the front of a vessel, and second end block 27 is positioned at the opposite end of the channel of track 20. Track 20 provides a housing for sled 30 and includes top surface 21, and side guide rails 22 that form a generally u-shaped channel for sled 30 to slide in. Top surface 21 of track 20 might be fastened underneath a deck of a pontoon boat, and a trolling motor assembly (not shown in FIGS. 2 and 3) is mounted on a bottom motor area 36 of bottom plate 32 of sled 30.

Threaded rod 28 is generally fixed between first end block 25 and second end block 27 by points 39 and 40, respectively, in a manner that permits rotation of threaded rod 28. One end of threaded rod 28 extends through second end block 27, and might be fastened to either a motor or mechanical crank (not shown in FIGS. 2 and 3) to enable rotation of threaded rod 28.

Sled 30 includes top plate 31 and bottom plate 32, which are fastened together at corresponding ends by hinge 33. Hinge 33 is generally positioned to face toward first end block 25. Threaded rod 28 passes through a corresponding threaded receptacle (e.g., one or more nuts) in top plate 31 so that when threaded rod 28 is rotated, sled 30 slides within the channel of track 20. Bottom plate 32 includes gear 34 formed about hinge 33, and first end block 25 includes a (gear) rack 26 formed on its bottom surface.

Track 20 further includes an open area 50 within the bottom of the channel, and a closed are 51. When sled 30 is within closed area 51, the edges of bottom plate 32 slide on, and are retained by, guide rails 22. When sled 30 is within open area 50, the edges of bottom plate 32 are no longer retained by guide rails 22, permitting bottom plate 32 to rotate about hinge 33 out of open area 50. When top plate 31 rides on threaded rod 28 in either open area 50 or closed area 51, top plate 31 is retained within the channel by threaded rod 28 and guide rails 22.

Figure 4B:
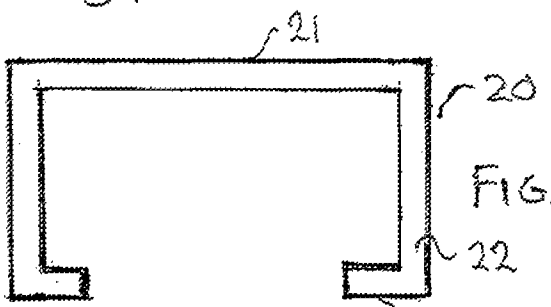
FIG. 4B shows a cross section of the track of exemplary embodiment of FIG. 2 showing the channel in a closed (guided) region allowing the sled to pass through closed region.
Figure 4A:
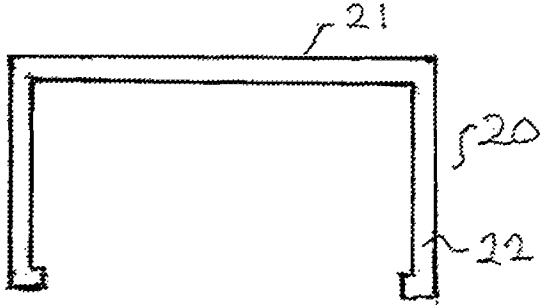
FIG. 4A shows a cross section of the track of exemplary embodiment of FIG. 2 showing the channel in an open region allowing a bottom plate of the sled to pass through the open region.

FIG. 4A shows a cross section of track 20 showing the channel in open region 50, allowing bottom plate 32 of sled 30 to pass through open region 50. As shown, track 20 might include reinforced area 60 at bottom of guide rail 22, to provide some rigidity to an aluminum extrusion employed for track 20. FIG. 4B shows a cross section of track 20 showing the channel in closed (guided) region 51, allowing sled 30 to pass through closed region 51. As shown, track 20 might include reinforced area extended area 61 at bottom of guide rail 22, to allow sled 30 to sit within guide rails 22 on extended area 61 closed region 51 while being firmly retained within the channel.

Returning to FIGS. 2 and 3, rotating threaded rod 28 in a first direction through top plate 31 moves hinge 33 of sled 30 within the channel toward first end block 25, and rotating threaded rod 28 in a second direction moves sled 30 within the channel toward second end block 27. When threaded rod 28 rotates in the first direction and reaches first end block 25, gear 34 of bottom plate 32 engages rack 26 of first end block 25, bottom plate 32 rotates about hinge 33 to flip bottom plate 32 through the open area 50, and extends bottom plate 32 inverted over first end block 25 to an extended, or deployed, position. Blocks 29*a* and 29*b* are mounted about rack 26, and slots 38*a* and 38*b* are formed either side of or within gear 34. Blocks 29*a* and 29*b* may engage slots 38*a* and 38*b*, respectively, to allow for alignment and rigidity of extended bottom plate 32 in the deployed position. When a trolling motor assembly (not shown in FIGS. 2 and 3) is mounted on a bottom motor area 36 of bottom plate 32 of sled 30, this rotation about hinge 33 to flip bottom plate 32 through the open area 50 also flips the trolling motor assembly over to be positioned, for example, on the deck surface of a pontoon boat. Recess 41 shown at a rear of bottom plate 32 might allow space for a propulsion shaft of the trolling motor assembly to move up and down.

From a deployed position, rotating threaded rod 28 in a second direction moves sled 30 within the channel toward second end block 27, reversing the deployment operation. Bottom plate 32 rotates about hinge 33 to reverse-flip and return bottom plate 32 through open area 50, to retract bottom plate 32 into the channel of track 20 to a stowed position. As bottom plate 32 enters open area 50 and slides toward second end block 27, inclined areas 35*a* and 35*b* engage areas 61 (shown in FIG. 4B) of guide rails 22 to help lift bottom plate 32 of sled 30 into the closed area 51 of the channel of track 20.

Figure 5:
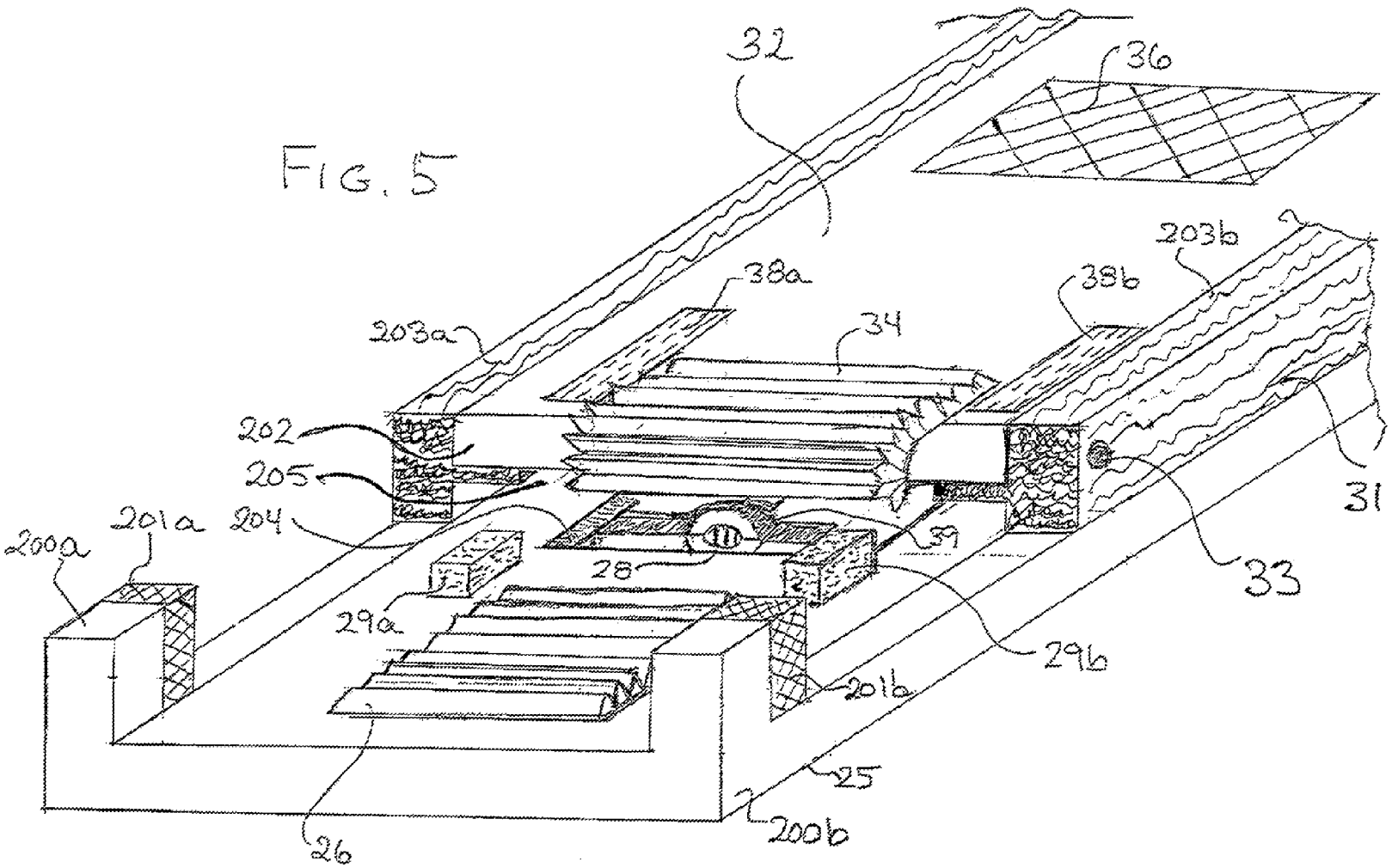
FIG. 5 shows a preferred configuration of the sled in accordance with described embodiments.
Figure 6:
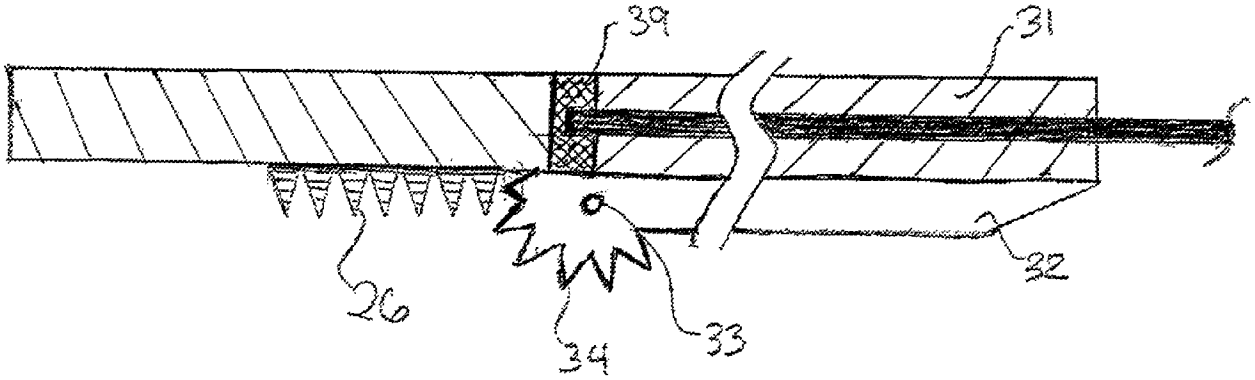
FIG. 6 shows a relation of the first end block and the top and bottom plates of the sled in a stowed position.
Figure 7:
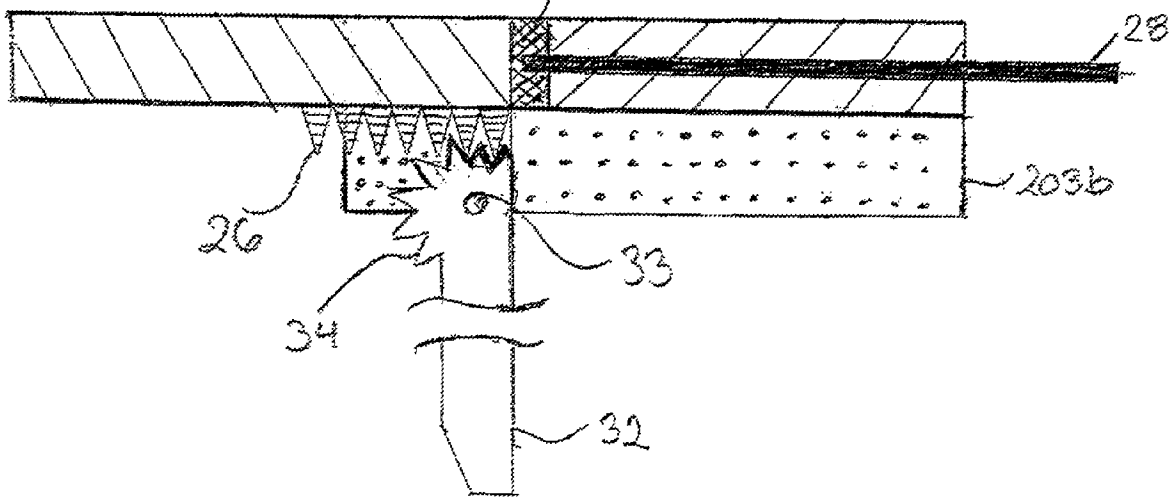
FIG. 7 shows a relation of the first end block and the top and bottom plates of the sled in a half-deployed position.

In order to provide the operation of inverting bottom plate 32, top plate 31 and bottom plate 32 are preferably configured as shown in FIGS. 5, 6 and 7. In operation, sled 30 passes over first end block 25, and top plate 31 passes over first end block 25 to engage gear 34 with rack 26. Bottom plate 32 is generally positioned within a recess in top plate 31, as shown and described below with respect to FIG. 5.

FIG. 5 shows sled 30 having top plate 31, bottom plate 32 with gear 34, and hinge 33 as it passes over first end block 25 during a transition between deployed and stowed positions. Nut 39 engages threaded rod 28 within a cavity of top plate 31, and sled 30 might be stopped at the end of first end block 25 by bumpers 200*a* and 200*b*, having cushions 201*a* and 201*b*, respectively. As shown, top plate 31 includes a recess 202 in which bottom plate 32 is positioned, with walls 203*a* and 203*b* extending to form recess 202 and provide support of hinge 33. As top plate 31 passes over first end block 25, it passes over rack 26, and opening 205 allows for gear 34 to make contact with rack 26. Continued movement of top plate 31 provides force for rotation about hinge 33. Blocks 29*a* and 29*b* may engage slots 38*a* and 38*b*, respectively, to allow for alignment and rigidity of extended bottom plate 32 in the deployed position. A trolling motor assembly (not shown in FIG. 5) is mounted on a bottom motor area 36 of bottom plate 32 of sled 30.

FIG. 6 shows a relation of the first end block and the top and bottom plates of the sled in a stowed position. FIG. 7 shows a relation of the first end block and the top and bottom plates of the sled in a half-deployed position when rotated 90 degrees by engagement of gear 34 with rack 26.

Figure 8:
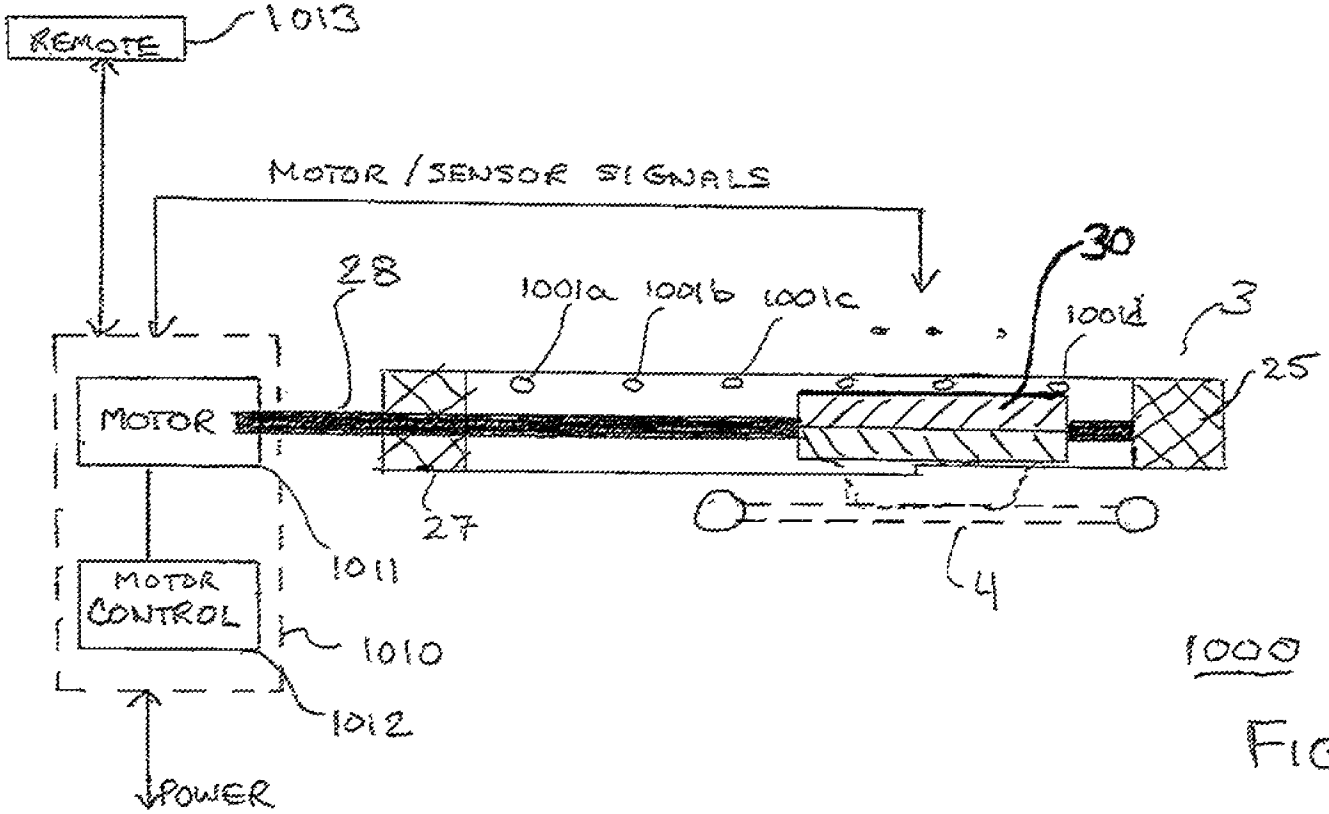
FIG. 8 shows a motor and motor control system as might be employed by exemplary embodiments of the present invention.

FIG. 8 shows a motor and motor control system 1000 as might be employed by exemplary embodiments of the present invention. As described above, rotation of threaded rod (e.g., screw) 28 moves sled 30 within the channel of track 20, thereby stowing or deploying trolling motor 4. Also, as described above, rotation of threaded rod 28 might be accomplished by an electric motor. Referring to FIG. 8, motor box 1010 includes electric motor 1011 to drive threaded rod 28, and operation of electric motor 1011 is enabled by motor control 1012. Given an input, which might, for example, be from remote device 1013 coupled to motor box 1010, motor 1011 rotates threaded rod 28 to stow or deploy trolling motor 4. Remote device 1013 might be implemented either directly or wirelessly coupled to motor box 1010. Motor control 1012 might be coupled to motor base 5 of trolling motor assembly 4, and might receive or provide control signals to trolling motor assembly 4 to rotate, flip and/or extend propulsion shaft 6 as the trolling motor assembly's configuration is changed to stow or deploy trolling motor 4. Motor mount 3 might further include sensors 1001*a*-1001*d* to monitor position of sled 30 within track 20 during operation, and sensors 1001*a*-1001*d* might provide position information signals to motor control 1010. Motor control 1012 might be implemented with simple circuitry, or might include a processor and associated circuitry to implement algorithms to more precisely control operation of motor and motor control system 1000. Such control in various embodiments might include speed of motor and sled, movements of the deployment or stowage of the trolling motor assembly during configuration changes, as well as safety precautions when jams or other non-desirable events occur during operation.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Moreover, the terms "system," "component," "module," "interface,", "model" or the like are generally intended to refer to a computer-related entity, either hardware, a combination of hardware and software, software, or software in execution. For example, a component may be, but is not limited to being, a process running on a processor, a processor, an object, an executable, a thread of execution, a program, and/or a computer. By way of illustration, both an application running on a controller and the controller can be a component. One or more components may reside within a process and/or thread of execution and a component may be localized on one computer and/or distributed between two or more computers.

Although the subject matter described herein may be described in the context of illustrative implementations to process one or more computing application features/operations for a computing application having user-interactive components the subject matter is not limited to these particular embodiments. Rather, the techniques described herein can be applied to any suitable type of user-interactive component execution management methods, systems, platforms, and/or apparatus.

The present invention can be embodied in the form of methods and apparatuses for practicing those methods. Aspects of the present invention can also be embodied in the form of program code embodied in tangible media, such as magnetic recording media, optical recording media, solid state memory, floppy diskettes, CD-ROMs, hard drives, or any other machine-readable storage medium, wherein, when the program code is loaded into and executed by a machine, such as a computer, the machine becomes an apparatus for practicing the invention. Aspects of the present invention can also be embodied in the form of program code, for example, whether stored in a storage medium, loaded into and/or executed by a machine, or transmitted over some transmission medium or carrier, such as over electrical wiring or cabling, through fiber optics, or via electromagnetic radiation, wherein, when the program code is loaded into and executed by a machine, such as a computer, the machine becomes an apparatus for practicing the invention. When implemented on a general-purpose processor, the program code segments combine with the processor to provide a unique device that operates analogously to specific logic circuits. The present invention can also be embodied in the form of a bitstream or other sequence of signal values electrically or optically transmitted through a medium, stored magnetic-field variations in a magnetic recording medium, etc., generated using a method and/or an apparatus of the present invention.

Unless explicitly stated otherwise, each numerical value and range should be interpreted as being approximate as if the word "about" or "approximately" preceded the value of the value or range.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

As used herein in reference to an element and a standard, the term "compatible" means that the element communicates with other elements in a manner wholly or partially specified by the standard, and would be recognized by other elements as sufficiently capable of communicating with the other elements in the manner specified by the standard. The compatible element does not need to operate internally in a manner specified by the standard.

Also for purposes of this description, the terms "couple," "coupling," "coupled," "connect," "connecting," or "connected" refer to any manner known in the art or later developed in which energy is allowed to be transferred between two or more elements, and the interposition of one or more additional elements is contemplated, although not required. Conversely, the terms "directly coupled," "directly connected," etc., imply the absence of such additional elements.

Further, the term "comprises or includes" and/or "comprising or including" used in the document means that one or more other components, steps, operation and/or existence or addition of elements are not excluded in addition to the described components, steps, operation and/or elements.

No claim element herein is to be construed under the provisions of 35 U.S.C. §112, sixth paragraph, unless the element is expressly recited using the phrase "means for" or "step for."

It is understood that various changes in the details, materials, and arrangements of the parts which have been described and illustrated in order to explain the nature of this invention may be made by those skilled in the art without departing from the scope of the embodiments of the invention as encompassed in the following claims.

I claim:

1. An apparatus including a motor mount (e.g., 3) to deploy a boat motor (e.g., 5), the apparatus comprising:

a track (e.g., 20) having a top surface (e.g., 21), guide rails (e.g., 22) extending along each side of the track to form a channel, a first end block (e.g., 25) between the guide rails e.g., 22) at a first end, a second end block (e.g., 27) between the guide rails (e.g., 22) at a second end, and a rod (e.g., 28) rotatably fixed between the first and second end blocks (e.g., 25 and 27), wherein:

the first end block has a rack (e.g., 26) formed thereon opposite to the top surface (e.g., 21), and the guide rails form an opening (e.g., 50) adjacent to the first end block (e.g., 25), between the first and second end blocks (e.g., 25 and 27), and opposite to the track top surface (e.g., 21); and a sled (e.g., 30) positioned within the channel having a top plate (e.g., 31) and a bottom plate (e.g., 32), the top plate and the bottom plate (e.g., 34) having corresponding ends fixed with a hinge (e.g., 33), the top plate fastened about the rod (e.g., 28), the bottom plate have a gear (e.g., 34) formed around the hinge (e.g., 33), and the hinge (e.g., 33) positioned facing toward the first end block (e.g., 25), wherein:

rotating the rod (e.g., 28) in a first direction through the top plate moves the hinge (e.g., 33) of the sled (e.g., 30) within the channel toward the first block (e.g., 25), and rotating the rod (e.g., 28) in a second direction moves the sled (e.g., 30) within the channel toward the second block (e.g., 27) and, when the rod (e.g., 28) rotates in the first direction and reaches the first block (e.g., 25), the gear (e.g., 34) of the bottom plate (e.g., 32) engages the rack (e.g., 26) of the first end block (e.g., 25), the bottom plate (e.g., 32) rotates about the hinge (e.g., 33) through the opening (e.g., 50), and extends inverted over the first end block (e.g., 25) to an extended position.

2. The apparatus of claim 1 wherein the rod is a screw, the top plate has nut formed thereon, and the screw rotates in the nut.

3. The apparatus of claim 2 wherein the screw includes a shaft passing through the second fixed block (e.g., 27), the shaft coupled to a drive motor (e.g., 1011) to turn the screw (e.g., 28).

4. The apparatus of claim 3, further comprising a processor and circuitry (e.g., 102) coupled to the drive motor (e.g., 1011) to control rotation of the rod (e.g., 28) via the drive motor (e.g., 1011).

5. The apparatus of claim 1 wherein the motor (e.g., 3) mounts to a bottom surface (e.g., 36) of the bottom plate (e.g., 32), the motor comprising a propulsion shaft (e.g., 6) and motor housing (e.g., 5), and wherein the propulsion shaft in a stowed position lies horizontal to the bottom surface of the bottom plate (e.g., 32) and the motor housing (e.g., 5).

6. The apparatus of claim 5 wherein, as the bottom plate (e.g., 32) rotates about the hinge (e.g., 33) and extends inverted over the first end block (e.g., 25) to an extended position, the propulsion shaft (e.g., 6) horizontal to the bottom surface of the bottom plate (e.g., 32) changes from the stowed position (e.g., FIG. 1A) to a deployed position (e.g., FIG. 1C) perpendicular to the motor housing.

7. The apparatus of claim 6, wherein the first end block includes at least one guide block (e.g., 29*a* and 29*b*) positioned on a corresponding side of the rack (e.g., 26), wherein, when the gear (e.g., 34) of the bottom plate engages the rack of the first end block, each guide block (e.g., 29*a* and 29*b*) engages a corresponding slot (e.g., 38*a* and 38*b*) formed in the gear (e.g., 34), thereby guiding the bottom plate through the opening (e.g., 50).

8. The apparatus of claim 1, wherein when the bottom plate is extended over the first end block and rod rotates in the second direction and reaches the first block: the bottom plate rotates about the hinge into the opening, the gear of the bottom plate disengages the rack of the first fixed block, and returns over the first end block to a retracted position.

9. The apparatus of claim 8, wherein the bottom plate comprises at least one incline (e.g., 35*a* and 35*b*) on the edges of the bottom surface of the bottom plate (e.g., 32), and in the retracted position as the rod rotates in the second direction the at least one incline (e.g., 35*a* and 35*b*) on the edges of the bottom surface of the bottom plate (e.g., 32) engages (e.g., at area 61) the guide rails (e.g., 22) to position the sled (e.g., 30) within the channel.

10. The apparatus of claim 1, wherein the apparatus is included in a pontoon boat e.g., 10), the motor mount (e.g., 3) positioned: (i) underneath a deck (e.g., 2) and between pontoons (e.g., 1*a* and 1*b*) of the pontoon boat, (ii) with the top surface (e.g., 21) of the track (e.g., 20) affixed underneath the deck (e.g., 2), and (iii) the channel in a direction horizontal with the deck (e.g., 2).

11. The apparatus of claim 1 wherein the first end block includes at least one guide block positioned on a corresponding side of the rack, wherein, when the gear of the bottom plate engages the rack of the first fixed block, each guide block engages a corresponding slot formed in the gear to guide the bottom plate through the opening.

* * * * *